US005997334A

United States Patent [19]

Goto

[11] Patent Number: 5,997,334

[45] Date of Patent: Dec. 7, 1999

[54] LATCHING SYSTEM FOR AN ELECTRICAL CONNECTOR

[75] Inventor: Kazuhiro Goto, Markham, Canada

[73] Assignee: The Whitaker Corporation, Wilmington, Del.

[21] Appl. No.: 09/108,493

[22] Filed: Jul. 1, 1998

Related U.S. Application Data

[60] Provisional application No. 60/053,180, Jul. 18, 1997.

[51] Int. Cl.[6] ..... H01R 13/627

[52] U.S. Cl. ..... 439/352; 439/357

[58] Field of Search ..... 439/350–355, 439/357, 358

[56] References Cited

U.S. PATENT DOCUMENTS

| | | | |
|---|---|---|---|
| 4,526,431 | 7/1985 | Kasukawa | 439/352 |
| 4,838,808 | 6/1989 | Fujiura | 439/352 |
| 5,376,014 | 12/1994 | Sumida | 439/352 |
| 5,429,525 | 7/1995 | McCoy | 439/352 |
| 5,529,512 | 6/1996 | Mlyniec | 439/352 |

*Primary Examiner*—Hien Vu

[57] ABSTRACT

The invention is directed to an electrical connector, comprising a main body having a latching arm extending therealong. The latching arm has a latching projection to engage a latching protrusion on a mating connector. A lifting arm extends from the main body and is directed towards the latching arm. The lifting arm is movable towards and away from the latching arm. The lifting arm has a ramped surface. Whereby, when the lifting arm is moved towards the latching arm, the ramped surface engages a bottom surface of the latching arm thereby deflecting the latching upwardly and away from the main body to disengage engagement between the latching arm and the latching projection.

16 Claims, 3 Drawing Sheets

130
132
122
124
122
126
132
130
100
128
114
128
131
118
129
131

40
130
124
132
48
D
C
124
D
128
130
122
122
132
100
118
C
128

LATCHING SYSTEM FOR AN ELECTRICAL CONNECTOR

This application claims benefit of Provisional Application Ser. No. 60/053,180 filed Jul. 18, 1997.

FIELD OF THE INVENTION

The invention is directed towards an electrical connector having a latching member.

BACKGROUND OF THE INVENTION

Many electrical connectors have a latching feature to secure the electrical connector with its mating electrical connector. A few of these connectors have arms that extend forwardly from an anchor point and which are deflected up and over a protrusion on the mating connector and then resiled to their normal position thereby latching under the projection and securing the two connectors together. In order to release the connection between the electrical connectors, it is necessary to then pull up on the forward end of the latching arm to release the projection on the mating connector.

An alternative design is one having an elongated latching arm with a pivot point in the center of the latching arm. The forward end of latching arm will resile over the top of a protrusion on the mating connector and latch the connectors together. In order to release this connector, it is only necessary to then press on the rear end of the latching arm to release the connection between the forward end of the latching arm and the protrusion.

The problem with the first connector described is that is it necessary for the operator to get a good grip on the forward end of the latching arm in order to release the engagement. In certain circumstances it may be difficult for the operator to reach the position of the forward end of the latching arm. The problem with the second design is that is often makes the connector longer in order to accommodate the longer latching arm.

What is needed is an improved electrical connector having a latching system that is easily released so that the electrical connectors can be unmated.

SUMMARY OF THE INVENTION

The invention is directed to an electrical connector, comprising a main body having a latching arm extending therealong. The latching arm has a latching projection to engage a latching protrusion on a mating connector. A lifting arm extends from the main body and is directed towards the latching arm. The lifting arm is movable towards and away from the latching arm. When the lifting arm is moved towards the latching arm, the lifting arm engages a bottom surface of the latching arm thereby deflecting the latching upwardly and away from the main body to disengage engagement between the latching arm and the latching projection.

The invention is further directed to an electrical connector having a latching arm for providing latching engagement with a latching protrusion on a mating connector. The electrical connector has lifting arms extending therefrom and directed towards the latching arm. The lifting arms are connected to the electrical connector by movable sections. The lifting arms are movable toward and away from the latching arm. When the lifting arm is moved toward the latching arm, the lifting arm engages a bottom surface of the latching arm thereby deflecting the latching arm upwardly and removing any engagement between the latching arm and the latching protrusion on the mating connector.

BRIEF DESCRIPTION OF THE DRAWINGS

Embodiments of the present invention will now be described with reference to the accompanying drawings, in which.

DETAILED DESCRIPTION OF EMBODIMENTS OF THE INVENTION

Figure 1:
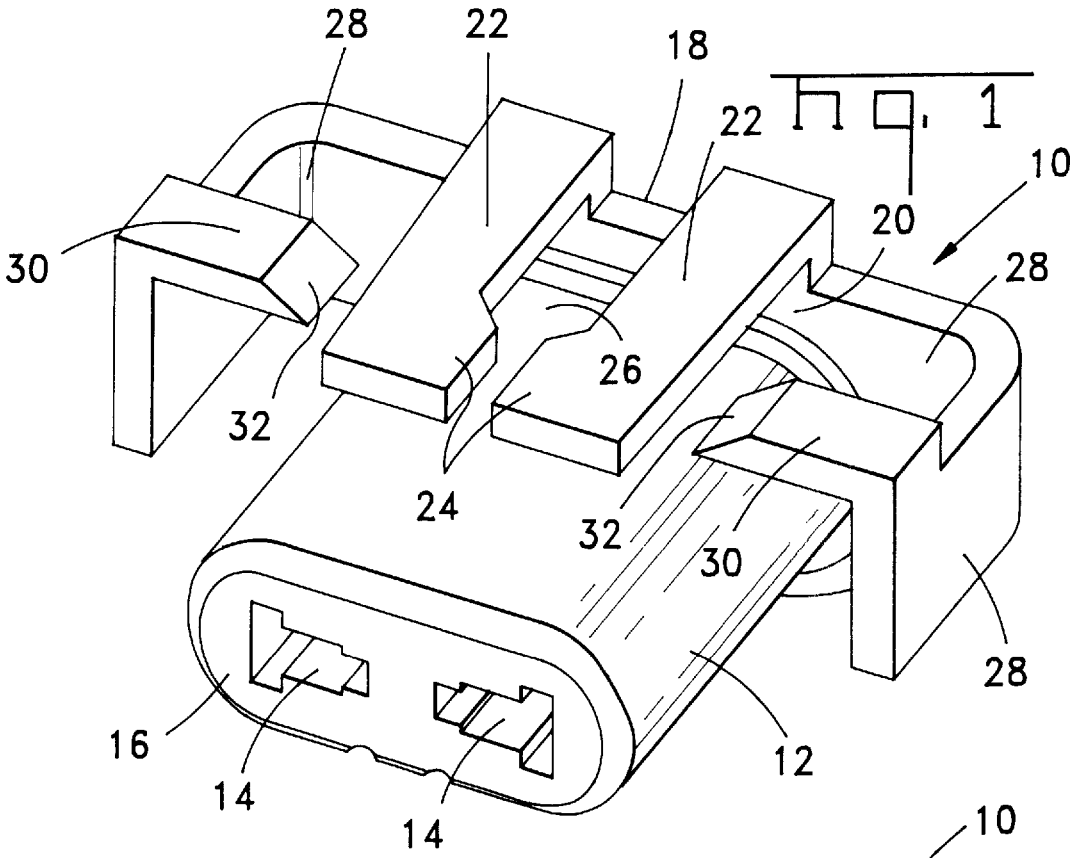
FIG. 1 is an isometric view of an embodiment of the present invention.

The present invention is directed towards a latching feature for an electrical connector. In particular, invention is directed towards an ergonomical latching feature which allows easy unlatching of an electrical connector from its mating connector.

The electrical connector 10 of the present invention includes a body 12 having contact receiving passages 14 extending therethrough. The contact receiving passages 14 extend from a front mating face 16 to a rear face 18. The contact receiving passages 14 are designed to receive electrical contacts therein for mating with the mating connector and providing an electrical connection thereto, not shown. The electrical connector 10 also has two individual latching arms 22 which extend from a rearward ledge 20. Each of the latching arms 22 have a latching projection 24 extending inwardly from a forward end of the latching arms 22. The latching arms 22 form a space 26 in which a latching protrusion from the mating connector is to be received. While the connector is described having two individual latching arms, the use of one integral latching arm is also within the scope of the invention.

The electrical connector 10 also has wings 28 which extend sideways from the rearward end 18 of the electrical connector 10. The wings 28 curve around the sides of the electrical connector 10 and have lifting arms 30 extending from a top forward end of the wings 28. The lifting arms 30 extend inwardly from the wings 28 towards the latching arm 22. Each of the lifting arms 30 have a ramped surface 32 which is also facing towards the latching arms 22. The wings 28 provide a movable member which can be pressed inward towards the main body 12 of the electrical connector 10. The function of the lifting arms and the latching arms will be described more fully hereinafter.

Figure 2:
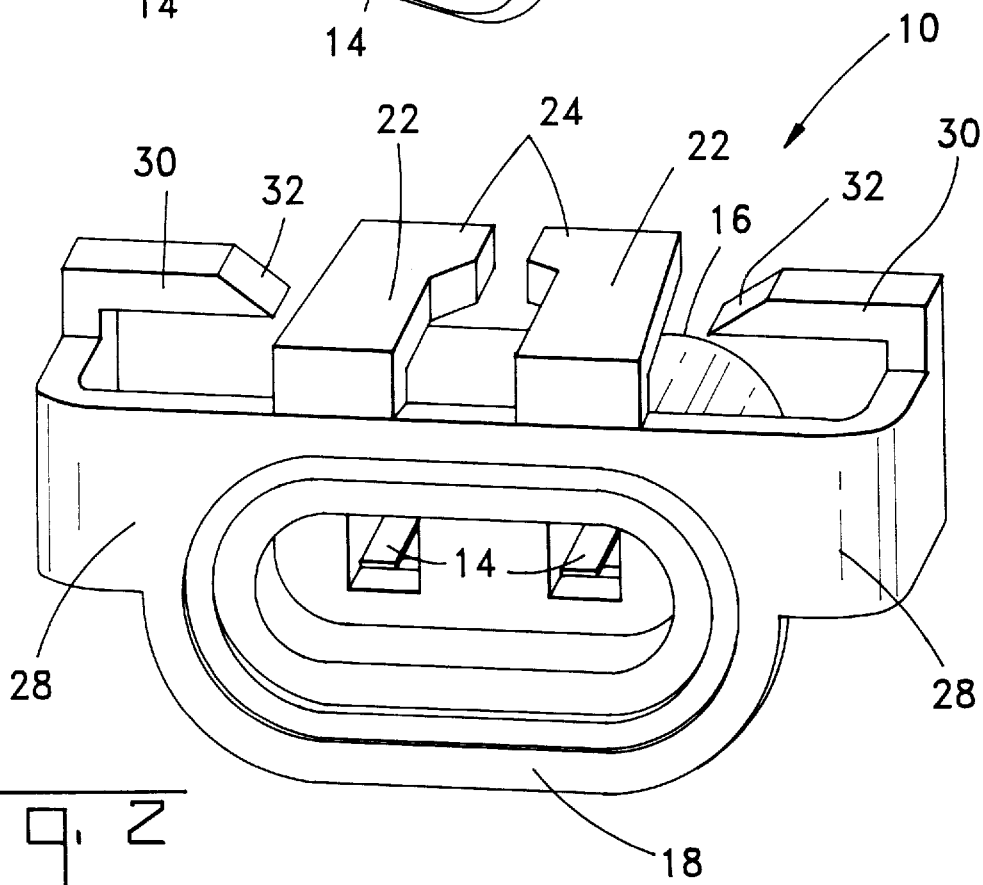
FIG. 2 is a rear isometric view of the electrical connector.

FIG. 2 is a rear view of the electrical connector 10 of the present invention. FIG. 2 shows the rear face 18 of the electrical connector 10 with contact receiving passages 14 extending therefrom. FIG. 2 also shows the extension of the wings 28 from the rear face 18 of the electrical connector 10.

Figure 3:
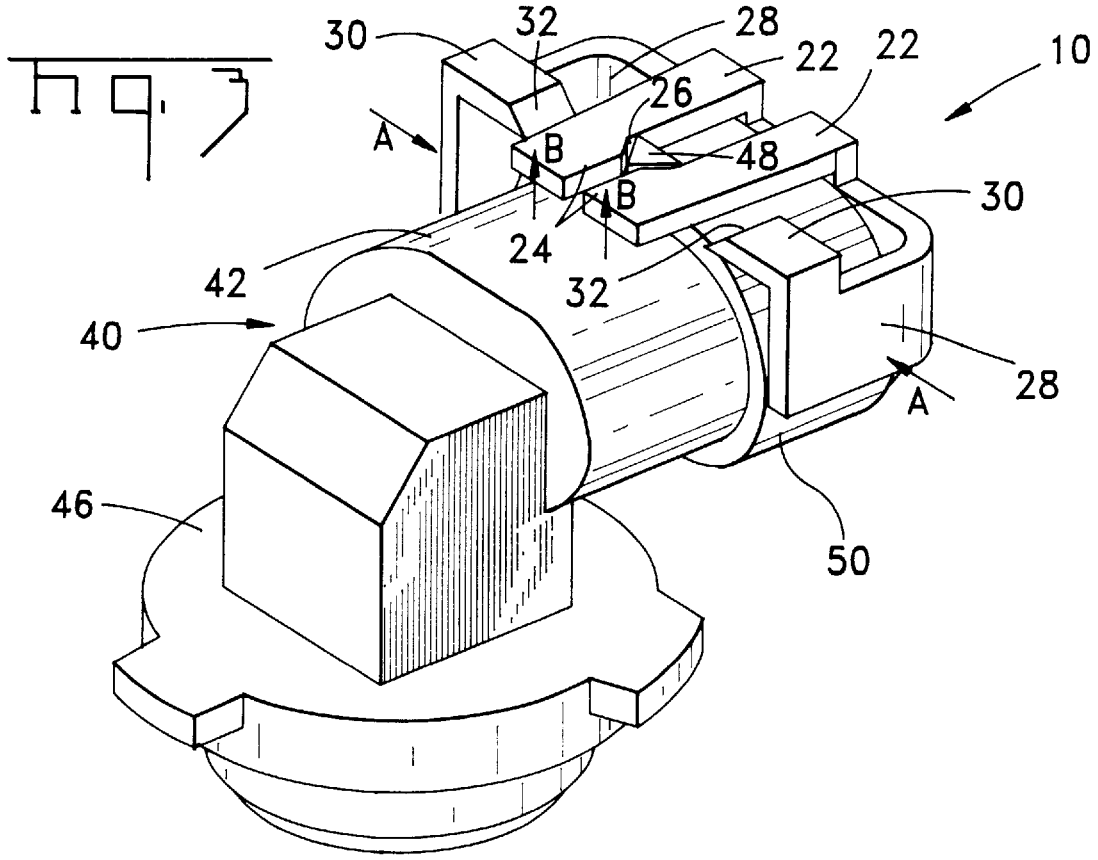
FIG. 3 is an isometric view of the electrical connector mated with the mating connector.

FIG. 3 shows the electrical connector 10 mated with a mating connector 40. The mating connector 40 is specifically shown as a head lamp socket connector, however, the mating connector 40 could be some other electrical connector having latching features.

The mating connector 40 has a body 42 having contact receiving passages therein, not shown with contacts to be mated with the electrical contacts in the contact receiving passages 14. The mating connector 40 has a mating end 44 and an operating end 46 in which the head lamp is mounted. The mating connector 40 also has a latching protrusion 48. The latching protrusion 48 is shown as a triangular shaped embossment in this embodiment, however it could be designed with some other shape or configuration. The mating connector 40 also has a shroud 50 which will be received around the body portion of the electrical connection 10 during mating.

During mating of the electrical connector 10 with the mating connector 40, the latching protrusion 48 will engage the forward end of the latching arms 22 on the electrical connector 10. The latching protrusion 48 will deflect the latching arms 22 upwardly so that the mating connector 40 can be moved more forwardly into the mating position. When the electrical connector 10 and the mating connector 40 are in the fully mated position, the latching arms 22 will resile to their normal position thereby latching on to the latching protrusion 48. The latching protrusion 48 will be received within the space 26 and the latching projections 24 will be received forwardly of the latching protrusion 48.

Occasionally, it is necessary to disconnect the electrical connector 10 from the mating connector 40, especially in situations where the mating connector 40 is a head lamp socket and it is necessary to replace a burned out lamp bulb. There may be other connector systems which it would be advantageous to have an easily disconnected electrical connector system.

In order to disconnect the electrical connector 10 from the mating connector 40, the operator would press inwardly on the wings 28, as shown by arrows A. By pressing inwardly on the wings 28, the lifting arms 30 will be pressed towards the latching arms 22 and the ramp surfaces 32 will also be pushed towards the latching arms 22. Upon engagement with the latching arms, the ramp surfaces 32 will engage bottom surfaces of the latching arms 22 and deflect the latching arms 22 upwardly in the direction indicated by arrow B. As the latching arms 22 are pushed upwardly, the engagement between the latching projections 24 and the latching protrusions 48 will be released because the latching arms 22 will be lifted up and over the upper surface of the latching protrusion 48. In this position, it is possible to remove the electrical 10 from the mating connector 40 because the latching engagement between the latching protrusion 48 and the latching arms 22 is released.

The electrical connector 10 and the latching system of the present invention has the advantages that is the operator only need press on the sides of the electrical connector 10 in order to disengage it from the mating connector. It is not necessary for the operator to be able engage the forward surface or end of the latching arm 22 in order to manually disengage the latching arms 22 of the latching protrusions 48. A further advantage of the electrical connector 10 of the present invention is that it can be made smaller because the latching arms 22 can be made without a pivot point in the middle of the latching arms to enable the latching arms to be easily released.

Figure 4:
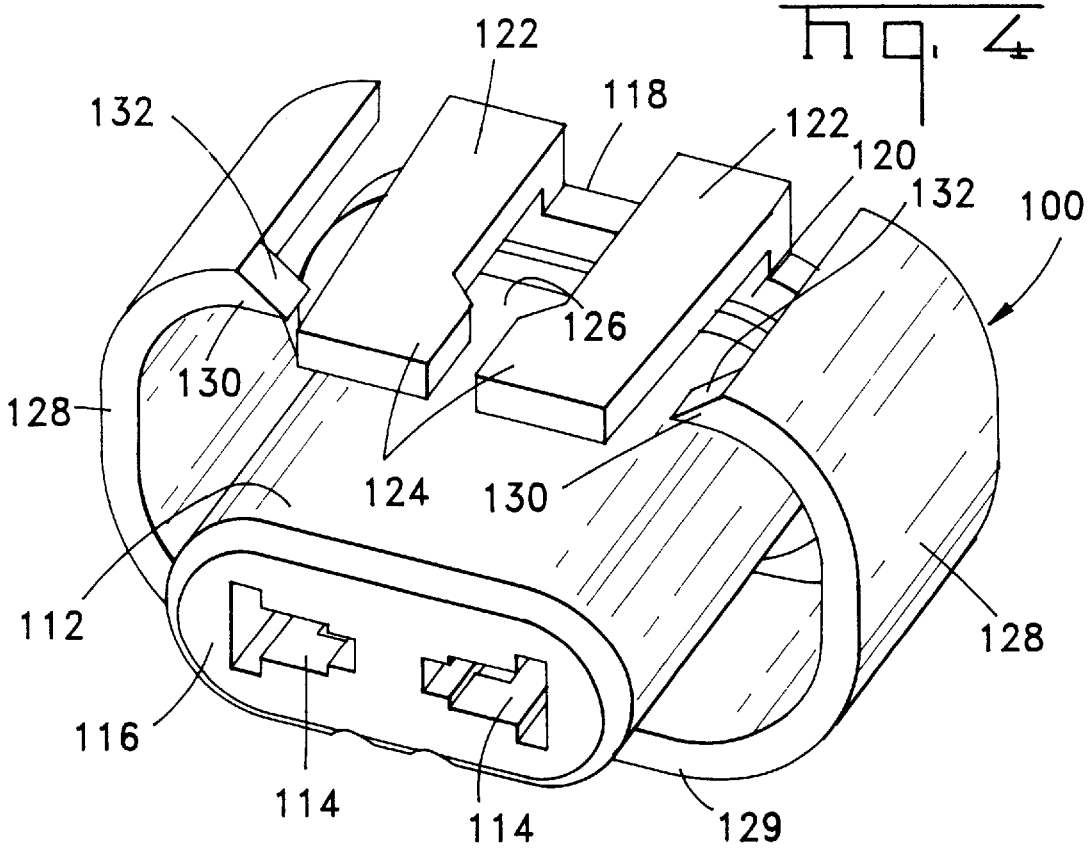
FIG. 4 is an isometric view of an alternative embodiment of the electrical connector of the present invention.

FIG. 4 shows an alternative embodiment of the electrical connector of the present invention. In a similar manner as was shown in the first embodiment, the electrical connector 100 has a main body 112 with contact receiving passages 114 extending therethrough. The contact receiving passages 114 are designed to receive electrical contacts therein, not shown, to be mated with the mating connector. The contact receiving passages 114 extend from a mating face 116 to a rearward face 118. Latching arms 122 extend from a rearward ledge 120. The latching arms 122 extend along the outer surface of the main body 112. The latching arms 122 have forward latching projections 124 on each latching arm 122. The latching arms 122 form a space 126 into which the latching protrusion will be received. The electrical connector 100 also has wings 128 which extend out from a shroud 129, shown in both FIGS. 4 and 5. The wings 128 differ from the wings 28 in that the wings 128 are a portion of a shroud which surrounds a large portion of the main body 112. Along ends of the wings 128 are lifting arms 130 which are directed towards the latching arm 122. The lifting arms 130 have ramp surfaces 132 which are also directed towards the latching arms 122.

Figure 5:
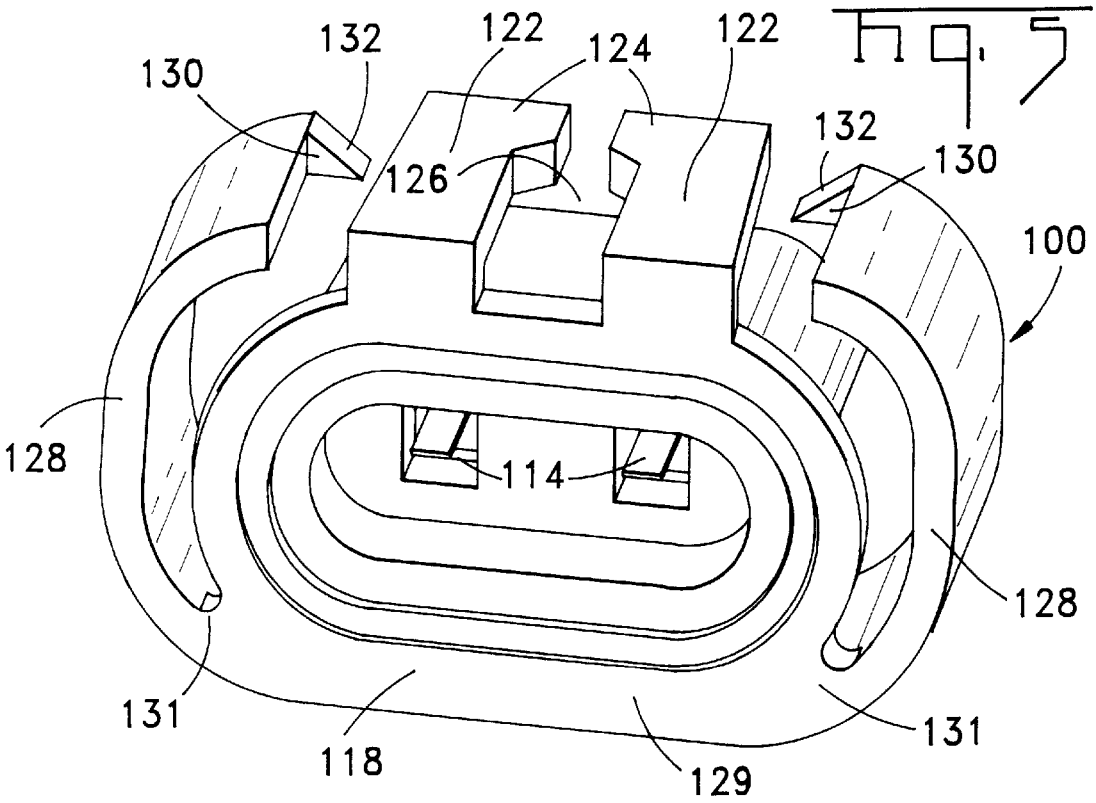
FIG. 5 is a rear view of the electrical connector of the present invention.

FIG. 5 shows a rear view of the electrical connector 100 of the present invention. In this view it can be seen that the contact receiving passages 114 extend from the rearward face 118 through to the mating face 116. Furthermore, it can be seen that the wings 128 extend from the outer shroud 129 and have a connection point or pivot point 131 towards the bottom as shown in FIG. 5 of the electrical connector 100. This gives the wings 128 a longer actuating surface in which they can be pivoted or moved about the pivot point 131. Therefore, when an operator presses on the middle of the wings 128, the lifting arms 130 each will travel a greater distance than that shown in the first embodiment. In this case the operator will have additional mechanical advantage over the wings 28 of the first embodiment.

Figure 6:
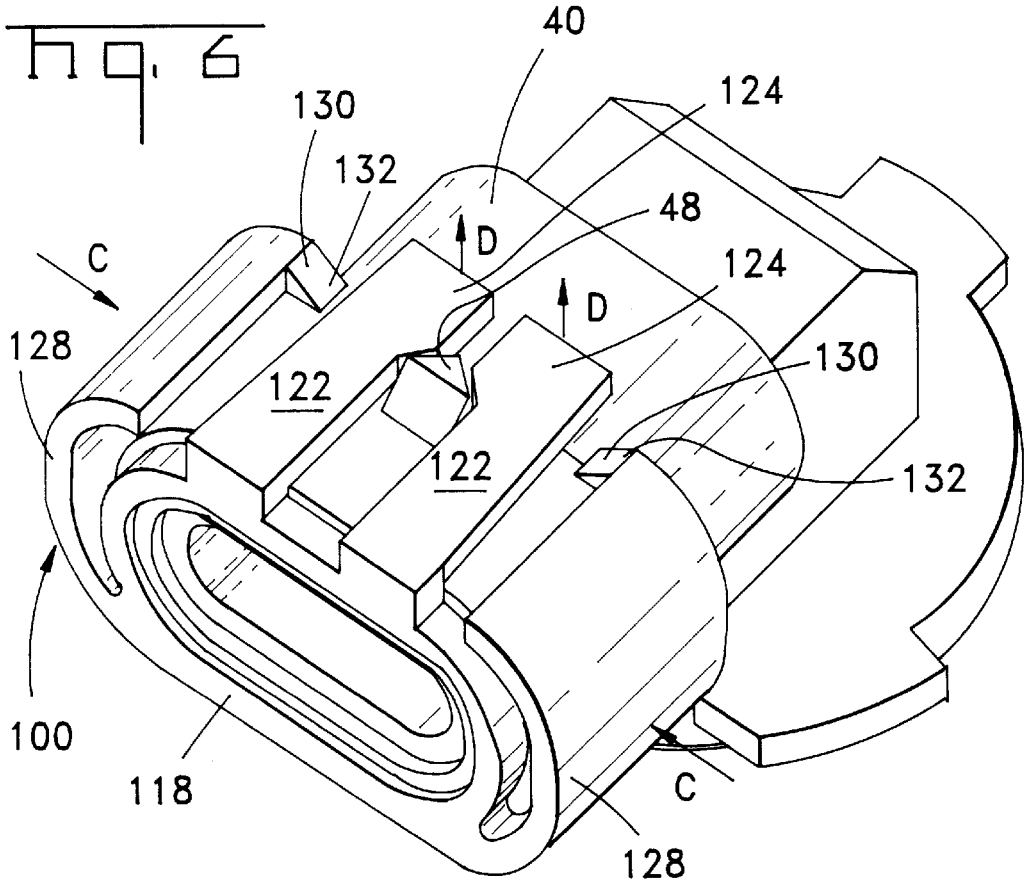
FIG. 6 is an isometric view of the second embodiment mated with the mating connector.

FIG. 6 shows the electrical connector 100 mated with the mating connector 40. The mating connector 40 is shown as the same connector as shown with the earlier embodiment, however it is to be understood that different mating connectors 40 can be used with the embodiments of the present invention. The mating connector 40 has latching protrusion 48 as was described earlier. When the mating connector 100 is mated with the mating connector 40, during the mating process, the latching arms 122 are deflected upwardly over the latching protrusion 48. When the electrical connector 100 and the mating connector 40 are fully mated, the latching arms 122 will resile to their normal position thereby latching on the latching protrusion 48.

When it is necessary to disconnect the electrical connector 100 from the mating connector 40, the operator will squeeze inwardly on the wings 128 in the direction indicated by the arrow C. The lifting arms 130 will be pushed inwardly towards the latching arms 122 and the ramp surfaces 132 will engage the bottom surfaces of the latching arms 122 thereby lifting the latching arms upwardly in the direction indicated by arrow D. This process will release the engagement of the latching arms 122 with the latching protrusion 48 thereby allowing the electrical connector to be removed from the mating connector 40.

The further advantage of the second embodiment of the electrical connector shown in FIG. 6 is that the wings 128 provide greater travel and actuation surface to provide a good lifting action on the latching arms 122. The second embodiment also has the advantage that the operator can just squeeze the sides of the electrical connector in order to disengage it from the mating connector 40. This means that the operator can release the electrical connector 100 without having to engage the forward end of the latching arms 122 to release it manually from the latching protrusion 48.

The electrical connector and latching system of the present invention and many of its attendant advantages will be understood from the foregoing description. It is apparent that many changes may be made in the form, construction, and arrangement of parts thereof without departing from the spirit or scope of the invention, or sacrificing all of its material advantages.

What is claimed is:

1. An electrical connector, comprising:

a main body having at least one latching arm extending therealong, said at least one latching arm having a latching surface to engage a latching projection on a mating connector; and at least one lifting arm extending from at least one wing and directed towards said at least one latching arm, said at least one wing being attached to the main body, said at least one lifting arm being movable towards and away from said at least one latching arm, whereby when said at least one lifting arm is moved toward said at least one latching arm, said at least one lifting arm engages a bottom surface of said at least one latching arm thereby deflecting said at least one latching arm upwardly and away from the main body to disengage engagement between said at least one latching arm and the latching projection.

2. The electrical connector of claim 1, wherein said at least one lifting arm has ramped surfaces to engage said at least one latching arm.

3. The electrical connector of claim 1, wherein said at least one latching arm comprises two individual arms with a space therebetween, each of the individual arms having a latching projection.

4. The electrical connector of claim 1, wherein said at least one wing forms a portion of a shroud around the main body.

5. The electrical connector of claim 1, wherein said at least one wing extends from a rear of the connector, said at least one wing extending along the sides of the main body and said at least one lifting arm extending from said at least one wing.

6. An electrical connector comprising:

a dielectric housing having contacts therein;

a latching arm for providing latching engagement with a latching protrusion on a mating connector;

lifting arms extending from said housing and being directed towards the latching arm, the lifting arms being connected to the electrical connector by wings attached to said housing, the lifting arms being movable toward and away from the latching arm, when the lifting arm is moved toward the latching arm, the lifting arm engages a bottom surface of the latching arm thereby deflecting the latching arm upwardly and removing any engagement between the latching arm and the latching protrusion on the mating connector.

7. The electrical connector of claim 6, wherein the lifting arms have ramped surfaces to engage the latching arm.

8. The electrical connector of claim 6, wherein the latching arm comprises two individual arms with a space therebetween, each of the individual arms having a latching projection.

9. The electrical connector of claim 6, wherein the wings form a portion of a shroud around the main body.

10. The electrical connector of claim 6, wherein the wings extend from a rear of the electrical connector, the wings extending along the sides of the electrical connector and the lifting arms extend from the wings.

11. An electrical connector comprising a housing having electrical contacts therein, the housing having a latching arm to engage a mating connector, the latching arm having a first position and a second deflected position, the housing having lifting arms which extend directed toward said latching arm and are movable toward and away from the latching arm, when the lifting arms are moved toward the latching arm, a surface of the lifting arms engage the latching arm and lifts the latching arm from the first position to the second deflected position to unlatch said mating connector.

12. The electrical connector of claim 11, wherein the lifting arms have ramped surfaces to engage the latching arm.

13. The electrical connector of claim 11, wherein the latching arm comprises two individual arms with a space therebetween, each of the individual arms having a latching projection.

14. The electrical connector of claim 11, wherein the lifting arm extends from wings, the wings being attached to the housing.

15. The electrical connector of claim 14, wherein the wings form a portion of a shroud around the housing.

16. The electrical connector of claim 14, wherein the wings extend from a rear of the housing, the wings extending along the sides of the housing and the lifting arms extending from the wings.

* * * * *